US010870212B2

(12) United States Patent
Treu et al.

(10) Patent No.: US 10,870,212 B2
(45) Date of Patent: Dec. 22, 2020

(54) SAFETY RAZOR AND BLADE UNIT FOR SAFETY RAZOR

(71) Applicant: BEIERSDORF AG, Hamburg (DE)

(72) Inventors: Jens Treu, Hamburg (DE); Michael Lessmann, Hamburg (DE); Kesen Zeng, Hamburg (DE); Yvonne Neumann, Hamburg (DE); Ralf Hagens, Hamburg (DE); Philip Drescher, Hamburg (DE)

(73) Assignee: BEIERSDORF AG, Hamburg (DE)

( * ) Notice: Subject to any disclaimer, the term of this patent is extended or adjusted under 35 U.S.C. 154(b) by 121 days.

(21) Appl. No.: 15/758,384

(22) PCT Filed: Sep. 9, 2015

(86) PCT No.: PCT/EP2015/070662
§ 371 (c)(1),
(2) Date: Mar. 8, 2018

(87) PCT Pub. No.: WO2017/041845
PCT Pub. Date: Mar. 16, 2017

(65) Prior Publication Data

US 2018/0264663 A1 Sep. 20, 2018

(51) Int. Cl.
*B26B 21/22* (2006.01)
*B26B 21/40* (2006.01)

(52) U.S. Cl.
CPC ..... *B26B 21/227* (2013.01); *B26B 21/22* (2013.01); *B26B 21/4031* (2013.01); *B26B 21/4068* (2013.01)

(58) Field of Classification Search
CPC ..... B26B 21/227; B26B 21/4068; B26B 21/4012; B26B 21/14; B26B 21/22; B26B 21/222; B26B 21/4031
See application file for complete search history.

(56) References Cited

U.S. PATENT DOCUMENTS 4,403,412 A 9/1983 Trotta
5,224,267 A * 7/1993 Simms ..... B26B 21/4068 30/50

(Continued)

FOREIGN PATENT DOCUMENTS

EP 1990142 A1 11/2008
EP 1990143 A1 11/2008
WO 0139937 a1 6/2001

*Primary Examiner* — Jason Daniel Prone
*Assistant Examiner* — Samuel A Davies
(74) *Attorney, Agent, or Firm* — Abel Schillinger, LLP

(57) ABSTRACT

The present disclosure describes a blade unit (10) for a safety razor (8). The blade unit comprises a blade housing (12), a plurality of blades (18) disposed within the blade housing (12) to expose respective cutting edges (20) suitable for shaving, and a blade carrier supporting the plurality of blades (18). The blade housing (12) has a base on which the blade carrier is supported. The plurality of blades (18) and the blade carrier being displaceable downwards towards the base of the blade housing (12) during shaving, wherein an amount of downward displacement of the plurality of blades (18) and the blade carrier is limited by one or more protrusions extending upwards from the base of the blade housing (12).

17 Claims, 8 Drawing Sheets

(56) References Cited

U.S. PATENT DOCUMENTS

| | | | | |
|---|---|---|---|---|
| 5,347,714 | A * | 9/1994 | Prochaska | B26B 21/227 30/32 |
| 6,671,961 | B1 * | 1/2004 | Santhagens Van Eibergen | B26B 21/227 30/50 |
| 7,992,304 | B2 * | 8/2011 | Nakasuka | B26B 21/227 30/50 |
| 8,104,179 | B2 * | 1/2012 | Nakasuka | B26B 21/227 30/50 |
| 10,183,408 | B2 * | 1/2019 | Furuta | B26B 21/225 |
| 2009/0113716 | A1 * | 5/2009 | Wain | B26B 21/227 30/50 |
| 2009/0188112 | A1 * | 7/2009 | Prochaska | B26B 21/4012 30/34.05 |
| 2009/0288304 | A1 * | 11/2009 | Denkert | B26B 21/227 30/346.61 |
| 2010/0077619 | A1 * | 4/2010 | Follo | B26B 21/225 30/50 |
| 2014/0259678 | A1 * | 9/2014 | Hegemann | B26B 21/4068 30/50 |
| 2016/0279815 | A1 * | 9/2016 | Washington | B26B 21/222 |
| 2016/0279817 | A1 * | 9/2016 | Washington | B26B 21/443 |

* cited by examiner

SAFETY RAZOR AND BLADE UNIT FOR SAFETY RAZOR

FIELD

Embodiments described herein relate to safety razors and blade units for safety razors.

BACKGROUND

Safety razors are typically composed of a blade unit connected, either detachably or fixedly (permanently fixed or integrated), to a handle. Blade units are known which have one or more blades, often a plurality of parallel blades, each defining a cutting edge, with blade unit elements positioned in front of and behind (rear of) the cutting edge(s) (referred to as a "guard" and a "cap", respectively) in a shaving direction. A shaving aid, such as a lubricating strip, is often incorporated in one or both of these blade unit elements to improve shaving performance and lubricating treatment of the user's skin. The blades can be of the flexible type which are adapted to flex in the blade unit during shaving, i.e., to individually or collectively adjust to the contours of the skin during shaving. However, excessive flexing of the blades can lead to damage (e.g., deformation) of the blades which can, among other things, reduce shaving efficacy.

BRIEF SUMMARY

One aspect of the present disclosures provides a blade unit for a safety razor, comprising: a blade housing; a plurality of blades disposed within the blade housing to expose respective cutting edges suitable for shaving; and a blade carrier supporting the plurality of blades; the blade housing having a base on which the blade carrier is supported; the plurality of blades and the blade carrier being displaceable downwards towards the base of the blade housing during shaving, wherein an amount of downward displacement of the plurality of blades and the blade carrier is limited by one or more protrusions extending upwards from the base of the blade housing.

Limiting the amount downward displacement can prevent or reduce damage (e.g., deformation) of the blades under shaving forces while still allowing the blades to adjust to the contours of the skin during shaving. The term "displaceable downwards" or "downward displacement" is used to describe a direction or path towards the base of the blade housing. The base of the blade housing is on an opposite side of the blade housing from the exposed cutting edges.

The one or more protrusions can limit the amount of displacement of the plurality of blades and the blade carrier to about halfway between a non-displaced position of the plurality of blades and the blade carrier and the base of the blade housing. For example, the maximum downward displacement of the plurality of blades and the blade carrier can be between about 0.75 mm to 0.25 mm, preferably about 0.5 mm. This provides an optimal trade-off between flexibility and preventing or reducing damage of the blades. The term "non-displaced" refers to the position of the blades and the blade carrier when no force is applied to them. With a force of up to 500 gf (gram-force), the change in exposure of the cutting edges caused by the displacement can be not more than 0.4 mm.

The protrusion(s) can limit the downward displacement by contact with the blades and/or the blade carrier only when the blades and the blade carrier displace towards the base during shaving. This may prevent further movement downwards as soon as the protrusion(s) comes into contact, for example by simple abutment. It will be appreciated that the protrusion(s) may prevent further movement downwards in other ways, for example the protrusion(s) may be inclined so that the blade carrier slides down (is in sliding-contact with) a surface(s) of the protrusion(s) up to a point where no further movement downwards is possible. The protrusion(s) may be distributed on the base of the blade housing to limit the displacement uniformly. At least one of the protrusions can be arranged to engage with the blade carrier in order to limit the downward displacement of the plurality of blades and the blade carrier. Although it can be advantageous for the protrusions to engage the blade carrier rather than the blades in order to prevent or reduce damage to the blades, it will be appreciated that at least one of the protrusions can be arranged to engage one or more of the blades.

In general, the blade carrier can take any suitable form that allows the blades to adjust to the contours of the skin during shaving. Furthermore, one or more blade carriers can be provided so that the blades can be displaced downward either individually or collectively. However, it can be particularly advantageous if the blade carrier comprises a rack on which the plurality of blades is mounted and flexible legs that allow the (collective) downward displacement of the plurality of blades. The rack and flexible legs can be integrally formed. For example, the rack and flexible legs can be fabricated from a single piece of material. Alternatively, the rack and flexible legs can be fabricated as separate components and then attached to one another.

In general, the protrusion(s) can take any suitable form and/or position that limits the downward displacement of the plurality of blades and the blade carrier. For example, the protrusion(s) can be flat-topped. However, it can be particularly advantageous if at least one of the protrusions is a rack-engaging protrusion arranged to engage the rack in order to limit downward displacement of the plurality of blades and the blade carrier. For example, a rack-engaging protrusion can be provided to each end of the blades. This can ensure that the downward displacement is uniformly limited. The flexible legs can take any suitable form that allows the rack to be displaced downwards. However, it can be particularly advantageous if the flexible legs comprise pairs of flexible legs, the legs of each pair being connected together by a connecting member, at least one of the protrusions being a connecting member-engaging protrusion arranged to engage the connecting member in order to limit the downward displacement of the plurality of blades and the blade carrier. Furthermore, a plurality of connecting member-engaging protrusions can be arranged on the base to engage along the length of the connecting member. This can ensure that the downward displacement is uniformly limited.

The flexible legs can have feet, at least one of the feet being in contact with a metal plate disposed on the base of the blade housing, for example in slidable contact with the metal plate. This allows the displacement of the blade carrier to be smooth.

There can be two pairs of flexible legs and thus two connecting members, one forward of the plurality of blades and one to the rear of the plurality of blades, wherein a respective plurality of connecting member-engaging protrusions is arranged on the base to engage along the lengths of each of the connecting members. The provision of two pairs of flexible legs in such a configuration can provide stability and ensure that, when the blades are displaced downward, the displacement is uniform. Herein, the term "rear" is used to describe features of the blade unit that are positioned behind the blades when the blade unit is drawn across the skin, while the term "forward" is used to describe features of the blade unit that are positioned in front the blades when the blade unit is drawn across the skin. Incidentally, the term "front" is used to describe features of the blade unit that are positioned on the skin-contacting side of the blade unit (i.e., on a front-side of the blade unit), and the term "back" is used to describe features of the blade unit that are positioned on a side opposite the skin-contacting side of the blade unit (i.e., on a back-side of the blade unit).

The blades can be in electrical contact with the metal plate via the at least one of the feet, so as to form a galvanic cathodic protection system in which the metal plate functions as a sacrificial anode that corrodes and the plurality of blades function as a cathode that is protected from corrosion. In other words, the metal plate can have a more negative reduction potential (more positive electrochemical potential) than that of the blades. This can improve the lifetime of the blade unit. For example, the metal plate can be made of aluminium or an aluminium alloy and the blades of stainless steel. The blade carrier can be made of metal, for example molded by pressing a plate of austenitic stainless steel.

One aspect of the present disclosures provides a safety razor, comprising: the aforementioned blade unit; and a handle having a proximal portion to which the blade unit is fixed and a distal portion. The blade unit can be detachably connected or fixedly connected (permanently fixed or integrated) to the handle. The safety razor can include a pivoting mechanism that allows the blade unit to pivot with respect to the handle. The pivoting mechanism can allow the blade unit to pivot in any of three dimensional directions. However, it can be advantageous if the pivoting mechanism allows the blade unit to pivot back and forth about a longitudinal axis of the blades.

One aspect of the present disclosures provides a method of manufacturing a blade unit for a safety razor, comprising: providing a blade housing; providing a plurality of blades disposed within the blade housing to expose respective cutting edges suitable for shaving; and providing a blade carrier supporting the plurality of blades; the blade housing having a base on which the blade carrier is supported; the plurality of blades and the blade carrier being displaceable downwards towards the base of the blade housing during shaving, wherein an amount of downward displacement of the plurality of blades and the blade carrier is limited by one or more protrusions extending upwards from the base of the blade housing.

The above indicated aspects, embodiments and features may be combined with each other to achieve the advantageous effects as described above. Further embodiments, features, and advantages of the invention, as well as the structure and operation of the various embodiments of the invention are described in detail below with reference to the accompanying drawings.

BRIEF DESCRIPTION OF THE DRAWINGS

The accompanying drawings are incorporated herein and form a part of the specification.

FIG. 10(*b*) is a cross-sectional view of FIG. 8; and

DETAILED DESCRIPTION OF EMBODIMENTS

The following detailed description refers to the accompanying drawings that illustrate exemplary embodiments consistent with this invention. Other embodiments are possible, and modifications can be made to the embodiments without departing from the spirit and scope of the invention. Therefore, the detailed description is not meant to limit the invention.

Figure 1:
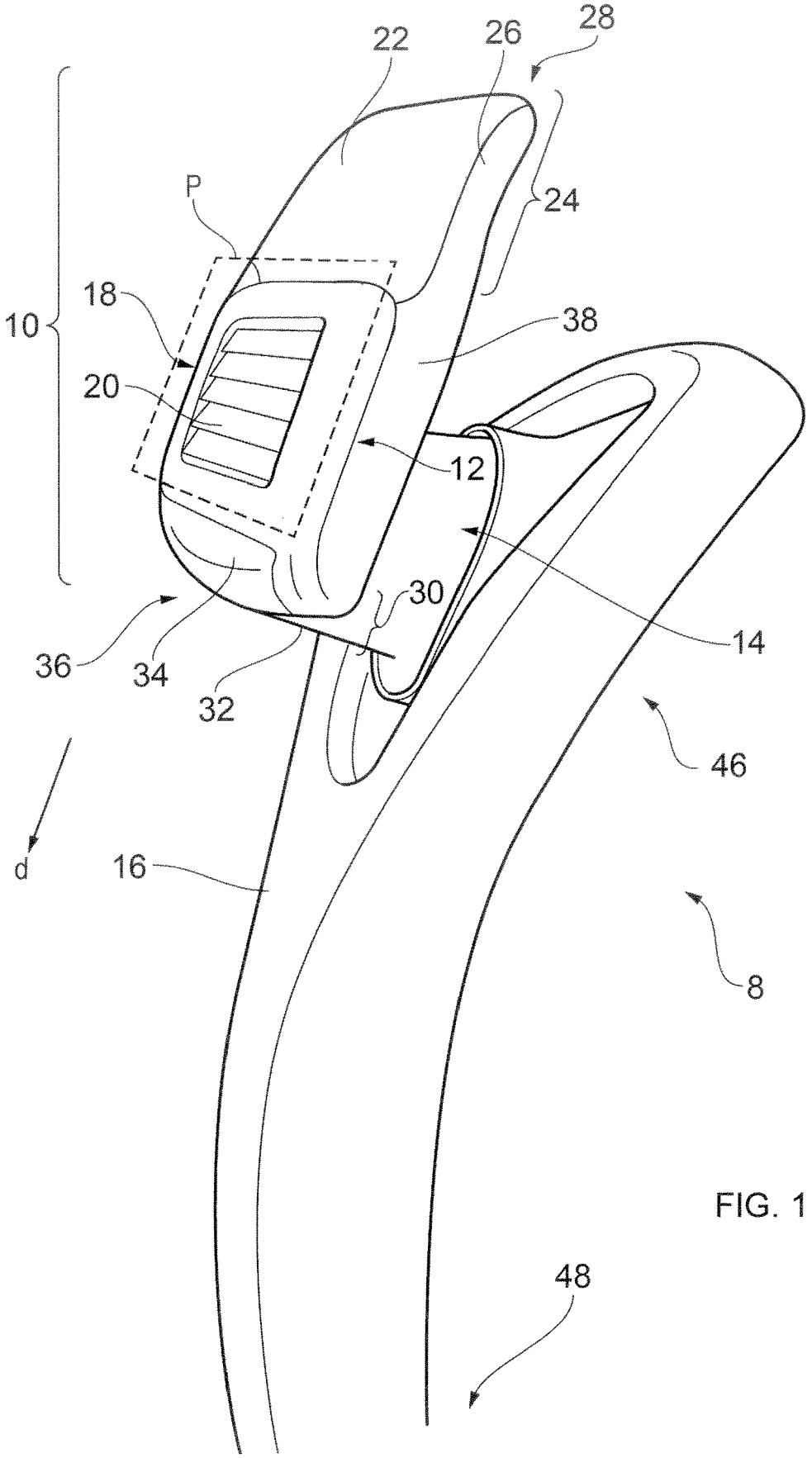
FIG. 1 is a perspective view of a safety razor including a blade unit.
Figure 2:
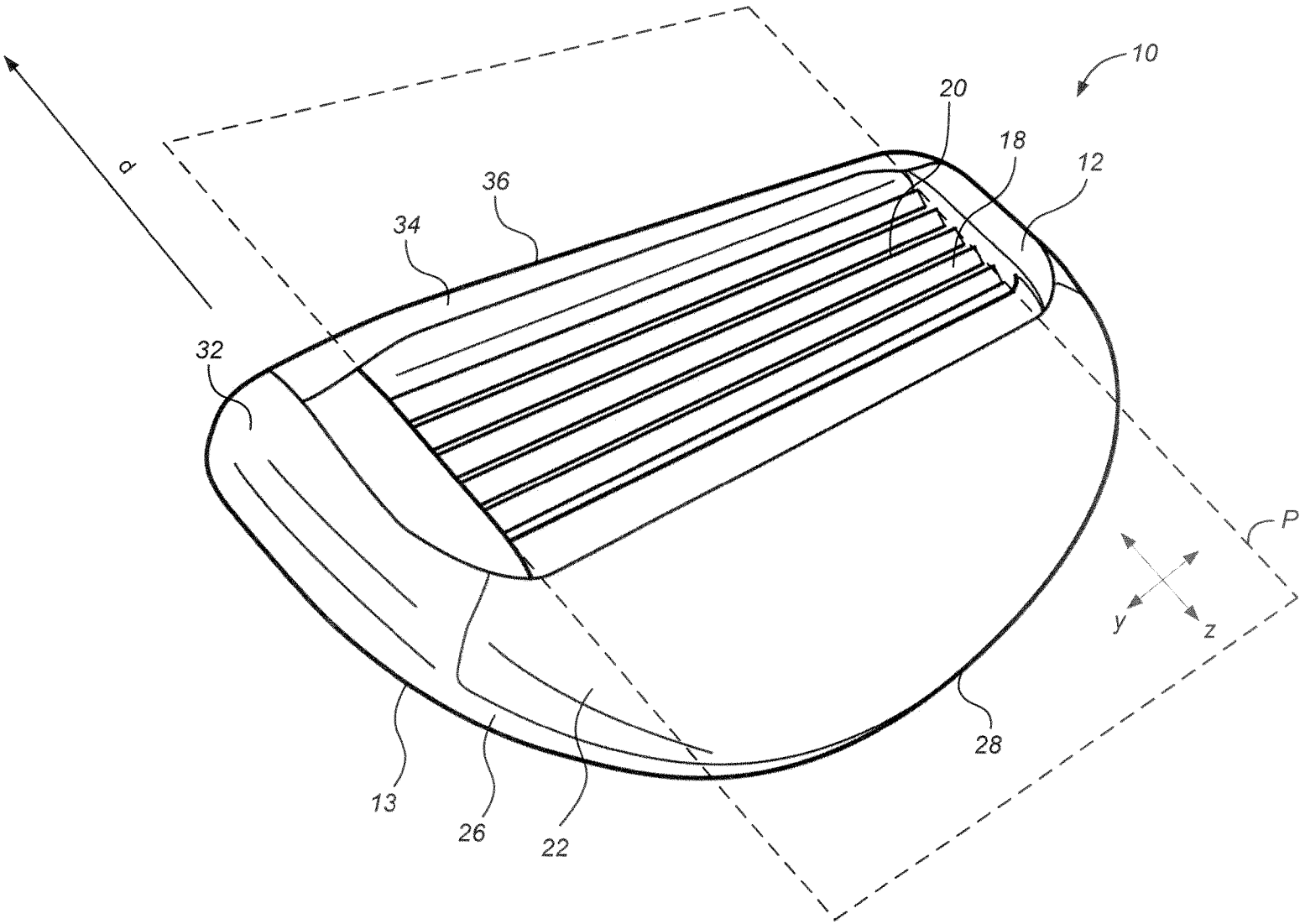
FIG. 2 is a perspective view of the blade unit shown in FIG. 1.
Figure 3:
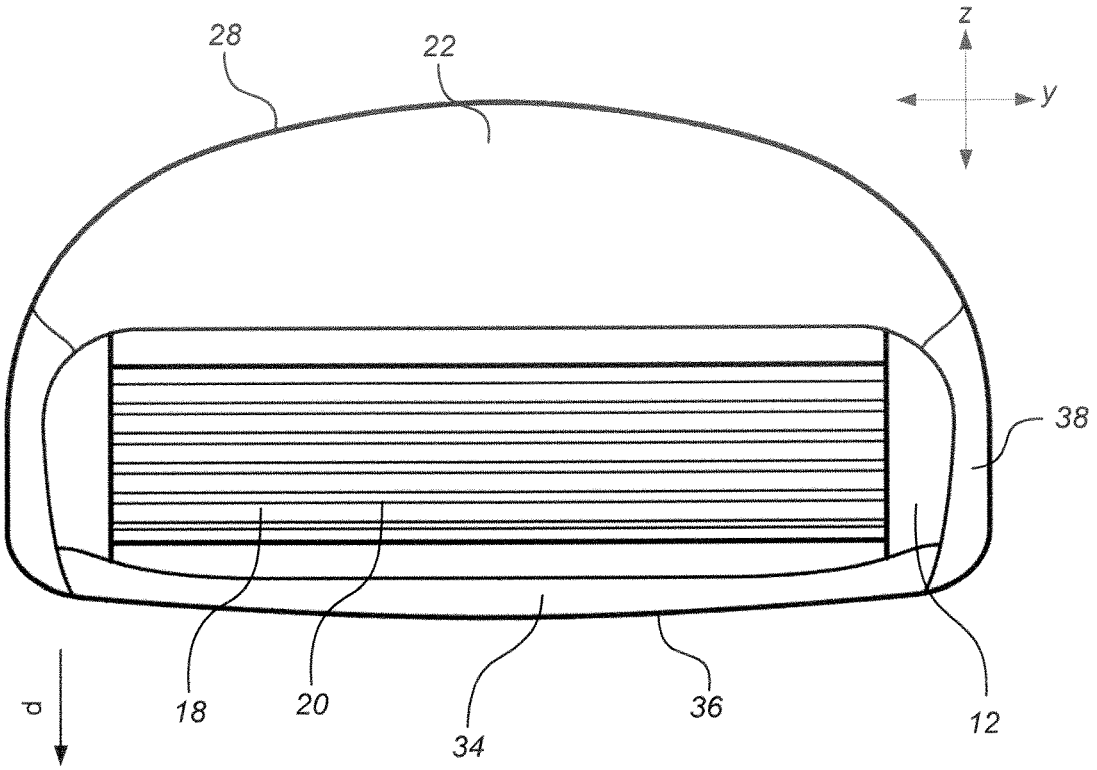
FIG. 3 is a view of the front of the blade unit shown in FIG. 1.
Figure 4:
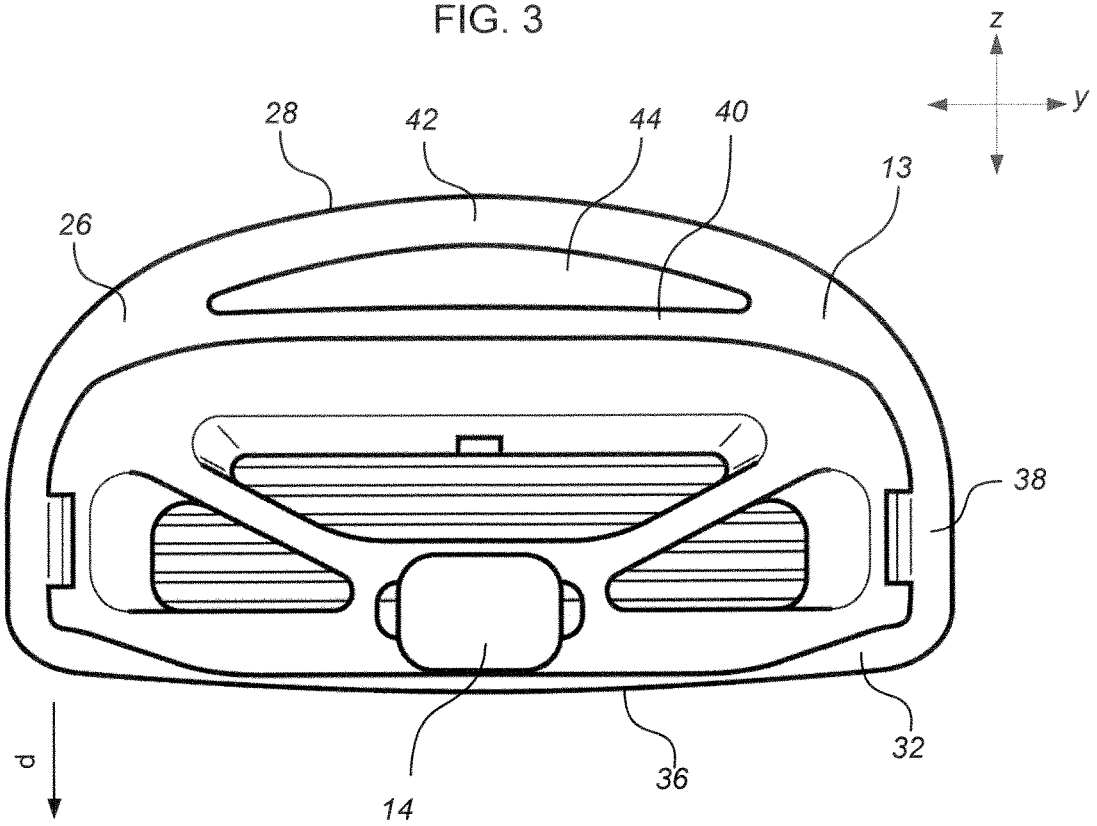
FIG. 4 is a view of the back of the blade unit shown in FIG. 1.
Figure 5:
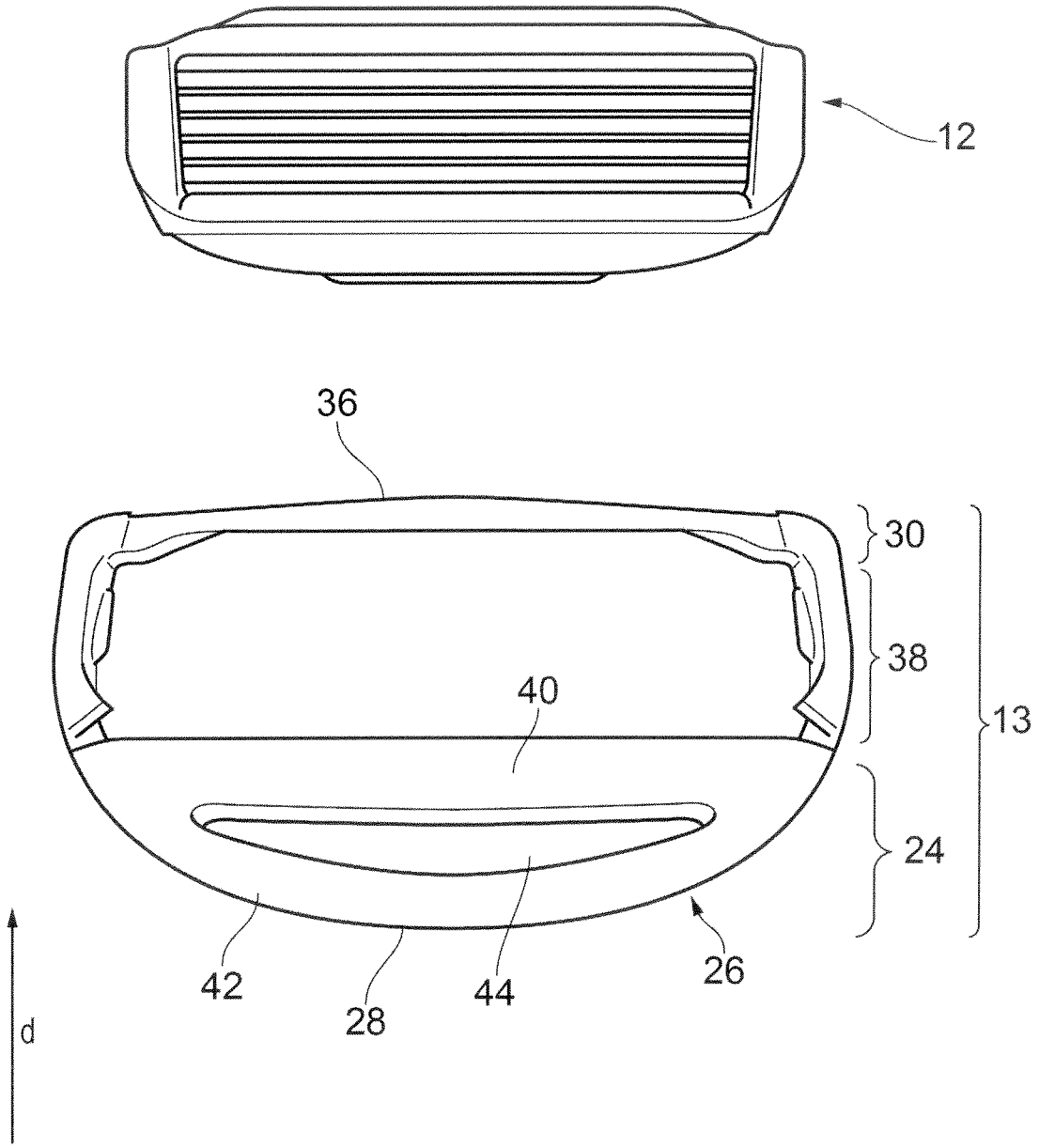
FIG. 5 is an exploded view of parts of the blade unit shown in FIG. 1.

Reference will now be made to FIGS. 1 to 5, which are views of a blade unit and safety razor including the blade unit. The safety razor 8 has a blade unit 10 and a handle 16 (only a part of which is shown in FIG. 1). The blade unit 10 includes a connecting structure 14 that fixes the blade unit 10 to the handle 16, a blade housing 12 and a supporting structure 13 of the blade housing 12. The blade housing 12 holds a plurality of blades 18 (five blades in this particular case) having respective cutting edges 20 that lie in a shaving plane P. Thus, as used herein, the term "shaving plane" generally refers to the place in which the cutting edges lie. The direction perpendicular to the shaving plane can be referred to as the thickness direction.

The supporting structure 13 comprises a cap 24 located behind the blades in a shaving direction d (when assembled) and a guard 30 located in front of the blade in the shaving direction d (when assembled). As such, the guard 30 is arranged next to the plurality of blades 18 in the shaving direction on an opposite side to that of the cap 24. As used herein, the term "shaving direction" signifies the direction in the shaving plane in which the blade unit is intended to be moved. The cap 24 and the guard 30 are connected by side portions 38. The supporting structure 13 controls the contact of the cutting edges 20 of the blades 18 with the skin during shaving.

The cap 24 of the supporting structure 13 comprises a non-flexible concave back portion 26 to which is mounted a convex lubricating pad 22. The terms "concave" and "convex" are employed herein to signify that the lubricating pad has a convex skin-engaging surface and the back portion has a concave surface along the back. The term "non-flexible" means that the concave back portion 26 has rigidity to an extent such that it does not bend during ordinary use of the safety razor 8.

The blade housing and the cap 24, and in particular the lubricating pad 22 and the non-flexible concave back portion 26 can be, for example, adhered, integrated, bonded and/or otherwise attached to each other.

The radius of curvature of the convex lubricating pad 22 can be set to about 10 mm, which is within a preferred range from 5 to 20 mm. Although the lubricating pad 22 is in a fixed positional relationship relative to the non-flexible concave back portion 26, the lubricating pad 22 can be deformed by, for example, a compressive force. The lubricating pad 22 can return substantially to its shape prior to deformation.

The non-flexible concave back portion 26 comprises a straight member 40 and an arched member 42 that are connected to each other at respective ends, so as to define a gap 44 in which part of the lubricating pad 22 is disposed when mounted thereon. The non-flexible concave back portion 26 and convex lubricating pad 22 meet flush at a rear edge 28 of the cap 24 of the blade unit 10 as can be seen from FIG. 1. The lubricating pad 22 is curved in an arc shape that extends along substantially the entire rear edge 28 between the side portions 38.

The guard 30 of the supporting structure 13 comprises a non-flexible back portion 32 on which is mounted an elongate lubricating strip 34. The non-flexible back portion 32 and elongate lubricating strip 34 meet flush at a front edge 36 of the guard 30 of the blade unit 10.

The terms "lubricating strip" and "lubricating pad" are used to signify that the length-to-width ratio in the shaving plane, i.e., the ratio of the size in a direction parallel to the blades (length direction) to the size in a direction parallel to the shaving direction d (width direction), of the elongate lubricating strip 34 and the convex lubricating pad 22 are different. In this particular case, the elongate lubricating strip 34 and convex lubricating pad 22 both extend at least along the length of the exposed cutting edges 20 of the blades 18 and have similar length, though the convex lubricating pad 22 is substantially wider than the elongate lubricating strip 34. In this particular case, the elongate lubricating strip 34 has a length-to-width ratio of about 10:1, while the convex lubricating pad 22 has a length to width ratio of about 4:1 at its widest point.

The composition of the lubricating strip/lubricating pad can include a gliding agent. Materials which may be selected as the gliding agent are: PEG-400/1,4-Butanediol/SMDI Copolymer, PEG-115M, PEG 45M, and PEG-5M, or a combination thereof. The composition of the lubricating strip/lubricating pad can include an antioxidant agent, for example Tocopherol. The composition of the lubricating strip/lubricating pad can include an anti-inflammatory agent, for example aloe barbadensis leaf juice. The composition of the lubricating strip/lubricating pad can include a backbone structure. Materials which may be selected as the backbone structure are: styrenic block copolymers and polystyrene, or a combination thereof. Preferably, the composition of the lubricating strip and the composition of the lubricating pad are the same, but this need not be the case.

The handle 16 has a proximal portion 46 closer to the blade unit 10 and a distal portion 48 (not shown in the Figures) farther from the blade unit 10. The connecting structure 14 of the blade unit 10 connects (either fixedly or detachably) to the proximal portion 46 of the handle 16. Thus, the blade unit 10 may be configured for use with a separate handle or may be permanently attached to the handle 16. The proximal portion 46 of the handle 16 also includes a pivot mechanism that allows the blade unit 10 to pivot back-and-forth in a plane perpendicular to the shaving plane P. The pivot mechanism can, of course, allow other pivoting motions such as side-to-side. The proximal portion 46 arcuately bends away from the shaving plane P, to permit the cap 24 of the blade unit 10 to pivot backwards, i.e., to bend away from the shaving plane, over a large angular range.

Figure 6:
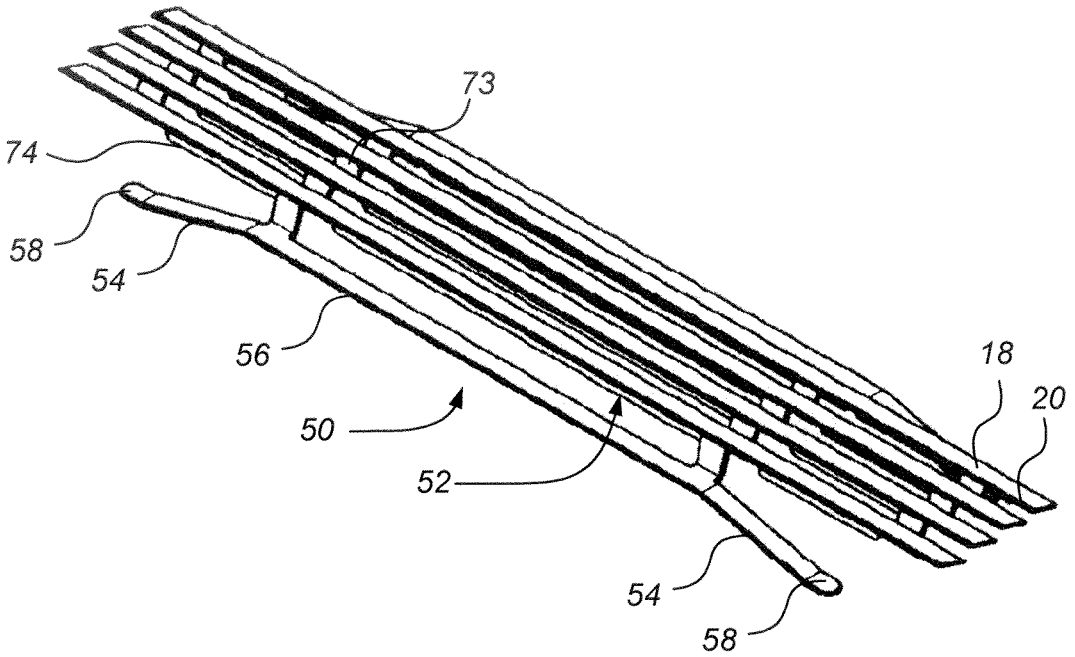
FIG. 6 is a perspective view of blades mounted on a blade carrier.

FIG. 6 shows an exemplary blade arrangement in which four blades 18 are mounted on a blade carrier 50 which comprises a rack 52, flexible legs 54, and connecting members 56 between the rack 52 and the flexible legs 54. The rack 52 is formed of runners (hidden from view in FIG. 6 by the blades 18) on which the blades 18 are mounted and which extend in the same direction as the blades 18, and cross pieces 73 joining the runners. The blades 18 are attached to the runners at several places, for example by spot welding or the like. The runners have downwardly extending fins 74 (reinforcement parts) that provide additional stiffness to the runners. The flexible legs 54 are grouped into pairs in which two flexible legs 54 are connected together by the connecting member 56 that is parallel to the longitudinal direction of the blades 18. One pair of flexible legs 54 is located in front of the plurality of blades 18 and another pair of flexible legs 54 is located to the rear of the plurality of blades 18 (the pair of flexible legs 54 located to the rear of the plurality of blades 18 is partially obscured from view in FIG. 6 by the blades 18.) Each flexible leg 54 is inclined downwards from the connecting member 56 to form a foot 58.

Figure 7:
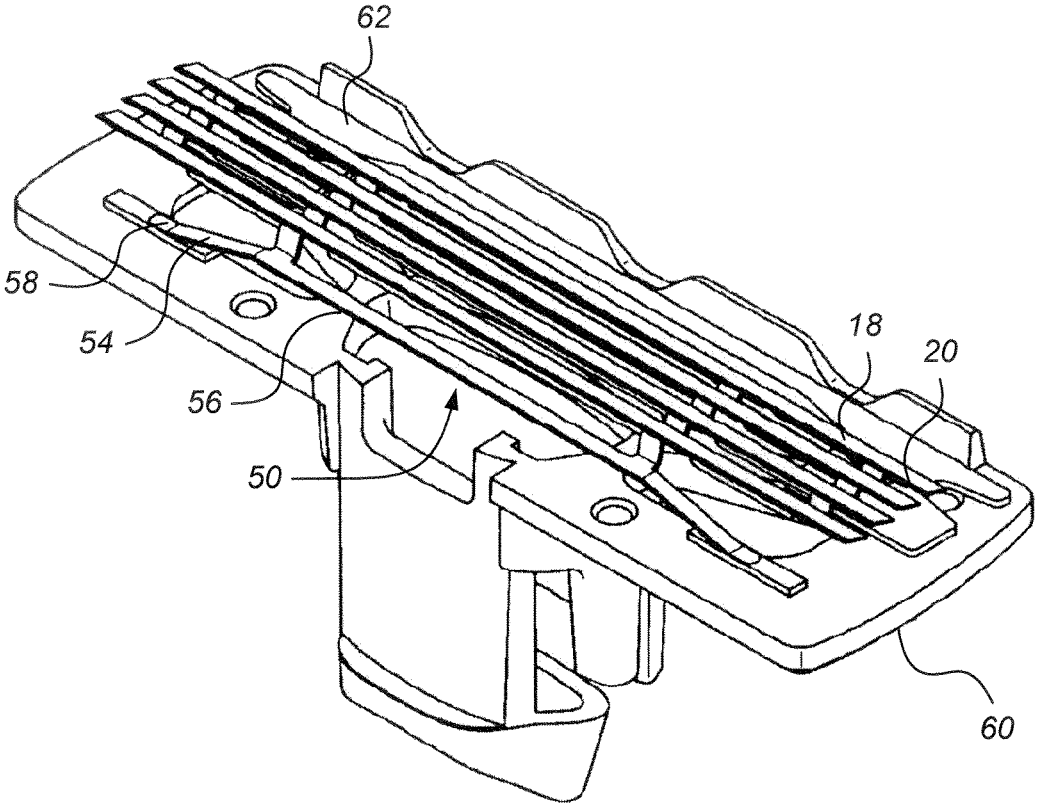
FIG. 7 is a perspective view of the blades and the blade carrier shown in FIG. 6, mounted on a base of a blade housing.

FIG. 7 shows how the blade arrangement of FIG. 6 can be disposed on a base 60 of a blade housing (only part of which is shown). The base 60 of the blade housing includes a metal plate 62 on an inner surface 66 of the base 60. As shown, the pair of flexible legs 54 located in front of the plurality of blades 18 are in permanent slidable contact with pads 64 of the inner surfaces 66, while the pair of flexible legs 54 located to the rear of the plurality of blades 18 are in permanent slidable contact with the metal plate 62. When the blades 18 are displaced down in the blade housing 12 during shaving, the blade carrier 50 is elastically deformed and the feet 58 slide easily along the metal plate 62 and pads 64, without limiting the downward movement. The blade carrier 50 and in particular the flexible legs 54 act as springs to return the blades 18 to the non-displaced position after shaving. However, if the displacement is too large, there may be permanent deformation of the blade carrier 50 and/or blades 18. Apart from a possible change to the shaving geometry (the relationship between the cutting edges of the blades as exposed in the blade unit with respect to the guard and/or the cap), one serious disadvantage of such permanent deformation is that the feet 58 may lose contact with the metal plate 62.

Figure 8:
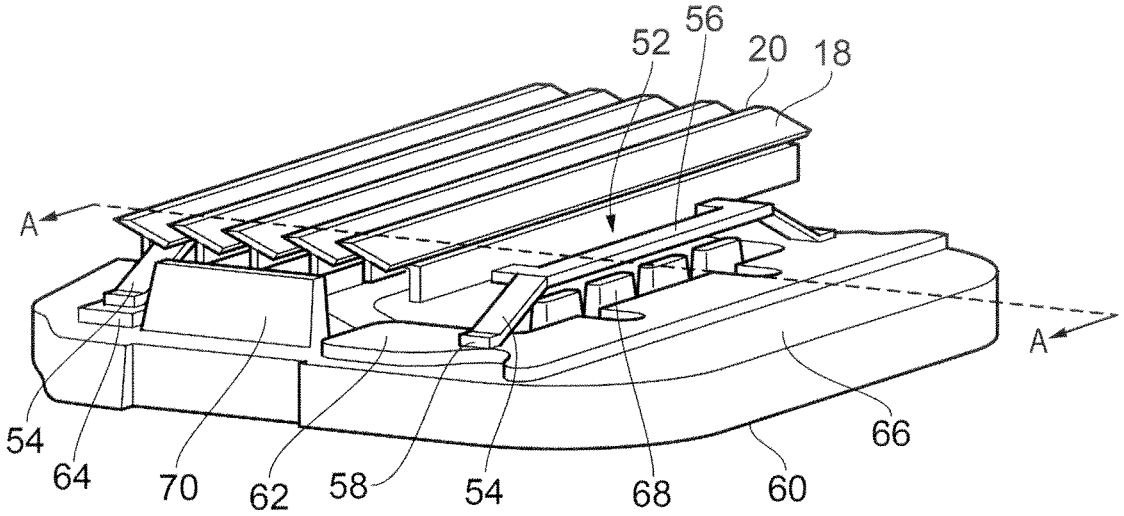
FIG. 8 is a perspective view of the blades and the blade carrier shown in FIG. 6, mounted on a base of a blade housing of a blade unit according to an embodiment.
Figure 9:
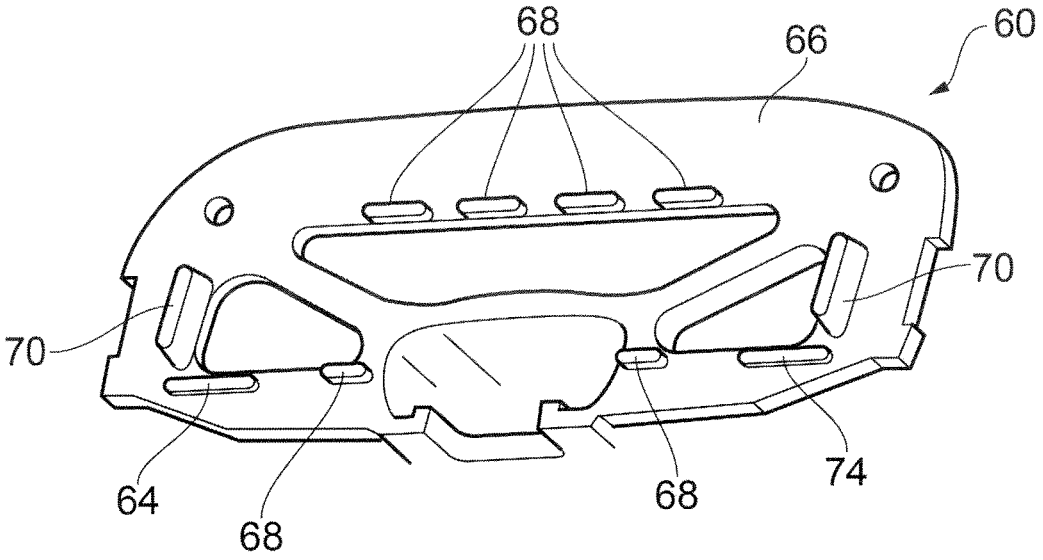
FIG. 9 is a perspective view of the base of the blade housing shown in FIG. 8.

FIG. 8 shows how the blade carrier 50 of FIG. 6 can be disposed on a base 60 of a blade housing 12 (only part of which is shown), according to an embodiment in which protrusions 68, 70 extend upwards from the base 60. FIG. 9 shows the base 60 of the blade housing 12 of FIG. 8 in more detail. (Components shown in FIGS. 8 and 9 that have the same reference numbers as those of FIGS. 6 and 7 are the same and are therefore not described.) The protrusions 68, 70 include connecting member-engaging protrusions 68 and rack-engaging protrusions 70. As described with reference to FIG. 7, when the blades 18 are displaced down in the blade housing 12 during shaving, the blade carrier 50 is elastically deformed and the feet 58 slide easily along the metal plate 62 and pads 64. However, now, once the connecting member 56 reaches the connecting-member engaging protrusions 68, further downward movement of the blade carrier 50 and the blades is prevented. Likewise, once the rack 52 (i.e., the runners) reach the rack-engaging protrusions 70, further downward movement blade carrier 50 is prevented. Here, the heights of the connecting-member engaging protrusions 68 and rack-engaging protrusions 70 are such that they engage the connecting member 56 and the rack 52 (i.e., the runners) at substantially the same time. Since the displacement of the blade carrier 50 and blades 18 is limited, deformation of the blade carrier 50 and/or blades 18 can be prevented or reduced. Consequently, it can be ensured, firstly, that the shaving geometry is maintained and, secondly, that the feet 58 remain in contact with the metal plate 62. In this regard, the metal plate 62 functions as a sacrificial (galvanic) anode of a galvanic cathodic protection (CP) system for protecting the blades 18 from corrosion. That is, the metal plate 62 is made of a metal with a more "active" voltage (more negative reduction potential/more positive electrochemical potential) than the metal of the blades. For example, the blades 18 can be made of stainless steel and the metal plate 62 can be made of aluminium. The difference in potential between the two metals means that the galvanic anode corrodes, so that the anode material is consumed in preference to the blades. By ensuring that the feet 58 remain in contact with the metal plate 62, corrosion of the blades 18 can be prevented or reduced.

Figure 10A:
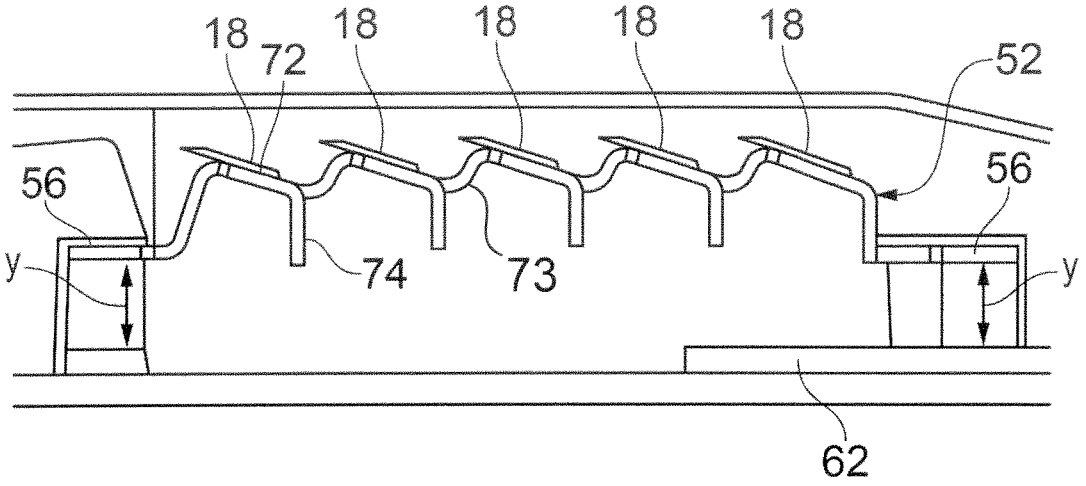
FIG. 10(*a*) is a cross sectional view of FIG. 7.
Figure 10B:
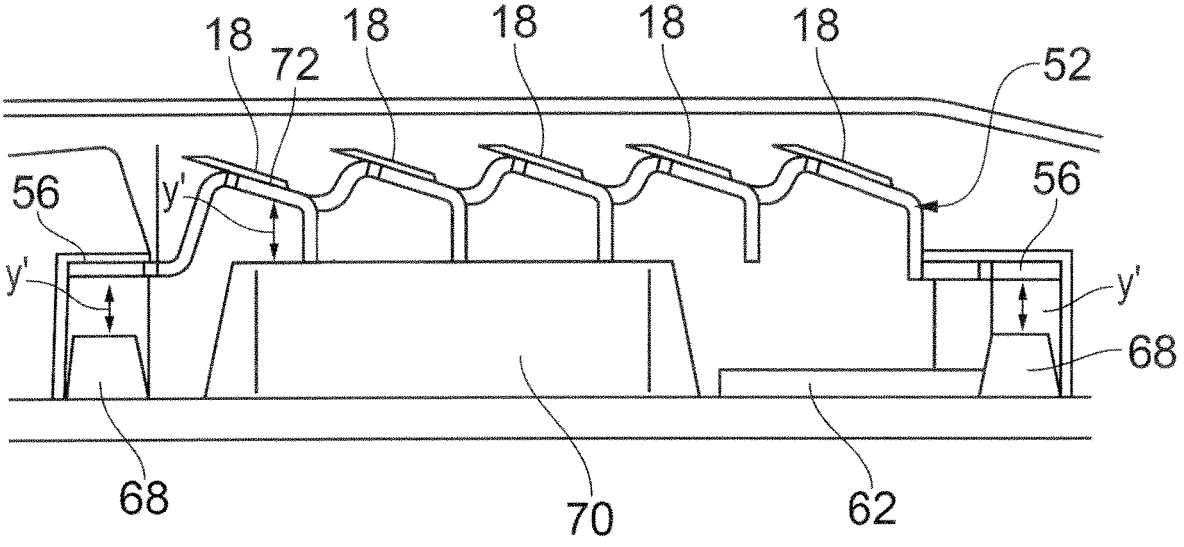

FIGS. 10(*a*) and 10(*b*) are cross-sectional views of part of the blade housing 12 in which the blade carrier 50 and blades 18 are housed. More specifically, FIG. 10(*a*) is a cross-sectional view of part of the blade housing 12 shown in FIG. 7 while FIG. 10(*b*) is a cross-sectional view through section A-A of part of the blade housing 12 shown in FIG. 8. The double-headed arrows shown in FIGS. 10(*a*) and 10(*b*) represent the amount of downward/upward movement that the blade carrier 50 and blades 18 can make. The blade carrier 50 and blades 18 shown in FIG. 10(*a*) can be displaced downward by a distance y of about 1 mm. In contrast, the blade carrier 50 and blades 18 shown in FIG. 10(*b*) can be displaced downward by a distance y' of about 0.5 mm. In more detail, when the blade carrier 50 and blades 18 shown in FIG. 10(*b*) are displaced down in the blade housing 12 during shaving, the rack 52 (and in particular the runners 72 on which the blades 18 are mounted) engages with the rack-engaging member 70, and the connecting members 56 engage with the connecting member-engaging protrusions 68. (It is noted that although the rack-engaging protrusion 70 does not lie in the plane of section A-A of FIG. 8, it is nevertheless shown in FIG. 10*b* to allow comparison with the connecting-member engaging protrusions 68. Thus, it will be apparent that in this particular embodiment the fins 74 do not contact the rack-engaging protrusion 70.)

Figure 11:
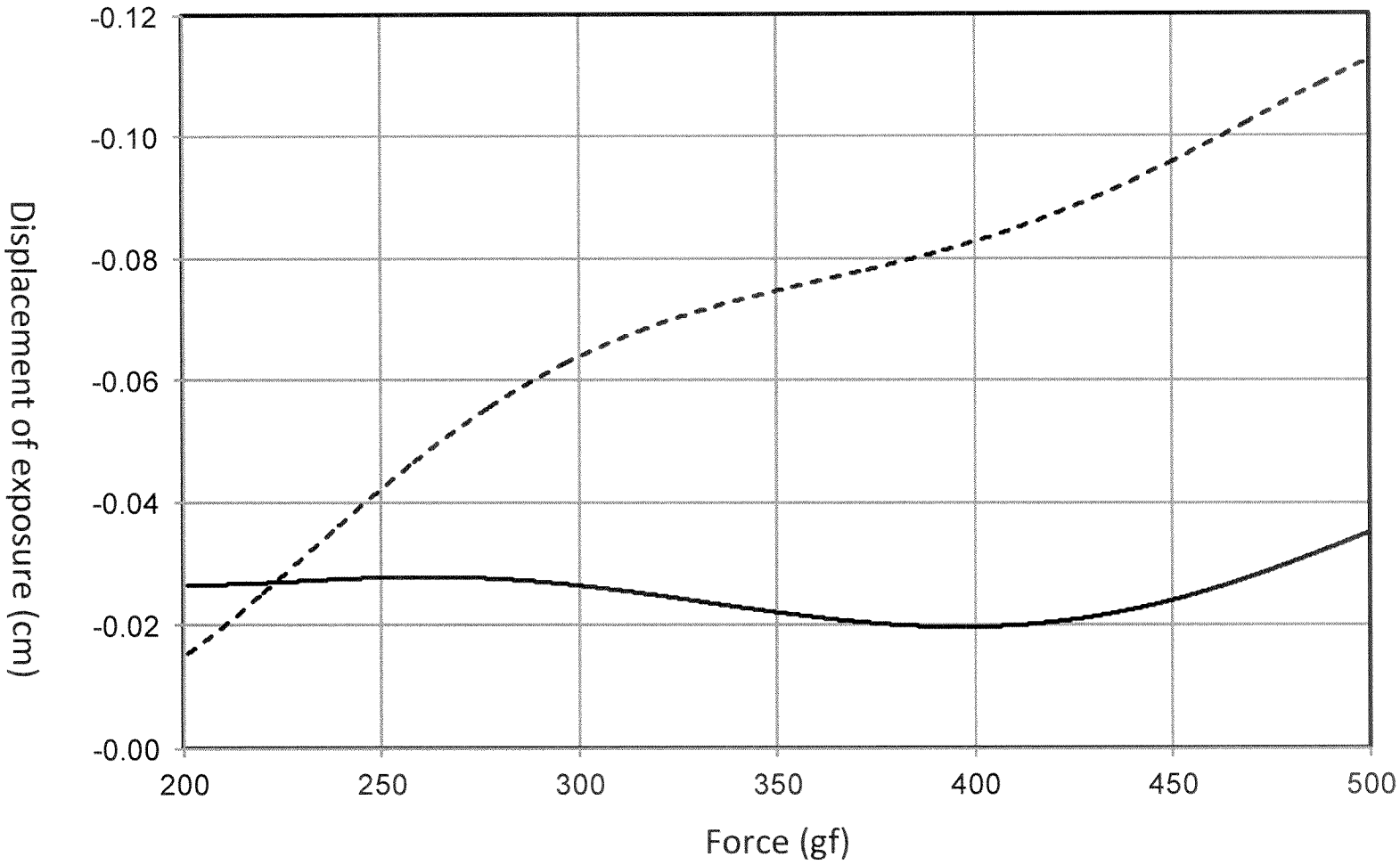
FIG. 11 is a graph of blade displacement of exposure versus force.

FIG. 11 is a graph showing displacement of exposure (i.e., how far the blades are displaced down in the blade housing 12) when subjected to a force (e.g., during shaving). The dashed line represents the case where no protrusions are provided on the base 60 (e.g., as in FIG. 7), while the solid line represents the case where protrusions are provided on the base 60 (e.g., as in FIG. 9). As can be seen from the graph, when no protrusions are provided on the base 60 the blades 18 are displaced downwards by about 1 mm when subjected to a force of 500 gf. By contrast, when protrusions are provided on the base 60 the blades are displaced downwards by no more than 0.4 mm when subjected to a force of 500 gf.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein.

Although blade units are described in which four or five parallel blades lying in a shaving plane are provided, the blade housing may comprise more than five blades or fewer than four blades, i.e., the blade housing may comprise at least one blade. When more than one blade is provided, these do not have to lie in a shaving plane, for example the blades could be staggered.

It is to be understood that the phraseology or terminology herein is for the purpose of description and not of limitation, such that the terminology or phraseology of the present specification is to be interpreted by the skilled artisan in light of the teachings and guidance.

For example, expressions such as "perpendicular", "parallel", "conform to" and the like are defined to mean "substantially perpendicular", "substantially parallel" and "substantially conform to". Likewise, the dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "30%" is intended to mean "about 30%".

The Summary and Abstract sections may set forth one or more but not all exemplary embodiments of the present invention as contemplated by the inventor(s), and thus, are not intended to limit the present invention and the appended claims in any way.

The breadth and scope of the present invention should not be limited by any of the above-described exemplary embodiments, but should be defined only in accordance with the following claims and their equivalents.

REFERENCE NUMBERS d shaving direction
P shaving plane
8 safety razor
10 blade unit
12 blade housing
13 supporting structure
14 connecting structure
16 handle
18 blades
20 cutting edges
22 convex lubricating pad
24 cap
25 non-flexible portion
26 non-flexible (concave) back portion
28 rear edge
30 guard
32 non-flexible back portion
34 elongate lubricating strip
36 front edge
38 side portions
40 straight member
42 arched member
44 gap
46 proximal portion
48 distal portion
50 blade carrier
52 rack
54 flexible leg
56 connecting member
58 foot
60 base
62 metal plate
64 pad

66 inner surface
68 connecting member-engaging protrusion
70 rack-engaging protrusion
72 runners
73 cross pieces
74 fins

What is claimed is:

1. A blade unit for a safety razor, wherein the blade unit comprises:

a blade housing;

a plurality of blades disposed within the blade housing to expose respective cutting edges suitable for shaving; and a blade carrier which supports the plurality of blades and comprises a rack on which the plurality of blades is mounted and flexible legs that allow a downward displacement of the plurality of blades and the rack;

the blade housing having a base on which the blade carrier is supported;

the plurality of blades and the blade carrier being displaceable downwards towards the base of the blade housing during shaving, an amount of downward displacement of the plurality of blades and the blade carrier being limited by one or more protrusions which extend upwards from the base of the blade housing, and the flexible legs comprising pairs of flexible legs, the legs of each pair being connected together by a connecting member, at least one of the one or more protrusions being a connecting member-engaging protrusion extending along a length of the connecting member.

2. The blade unit of claim 1, wherein the one or more protrusions limit the amount of displacement of the plurality of blades and the blade carrier to about halfway between a non-displaced position of the plurality of blades and the blade carrier and the base of the blade housing.

3. The blade unit of claim 1, wherein a maximum downward displacement of the plurality of blades and the blade carrier is from about 0.75 mm to about 0.25 mm.

4. The blade unit of claim 1, wherein a maximum downward displacement of the plurality of blades and the blade carrier is about 0.5 mm.

5. The blade unit of claim 1, wherein with a force of up to 500 gf, the change in exposure of the cutting edges caused by the displacement is not more than 0.4 mm.

6. The blade unit of claim 1, wherein the one or more protrusions limit the downward displacement in that the blade carrier comes into contact with the one or more protrusions only when the blade carrier displaces towards the base during shaving.

7. The blade unit of claim 1, wherein at least another one of the one or more protrusions is a rack-engaging protrusion arranged to engage the rack to limit downward displacement of the plurality of blades and the blade carrier.

8. The blade unit of claim 7, wherein rack-engaging protrusions are provided at each end of the blades.

9. The blade unit of claim 7, wherein heights of the at least one connecting-member engaging protrusion and the at least one rack-engaging protrusion are such that these protrusions engage the at least one connecting member and the rack at the same time.

10. The blade unit of claim 1, wherein a plurality of connecting member-engaging protrusions is arranged on the base to engage along a length of the connecting member.

11. The blade unit of claim 1, wherein the flexible legs have feet, at least one of the feet being in contact with a metal plate disposed on the base of the blade housing.

12. The blade unit of claim 11, wherein the at least one of the feet is in slidable contact with the metal plate.

13. The blade unit of claim 12, wherein there are two pairs of flexible legs, one forward of the plurality of blades and one to a rear of the plurality of blades and wherein the feet of only one pair of flexible legs are in contact with the metal plate.

14. The blade unit of claim 12, wherein the feet of the other pair of flexible legs are in contact with pads disposed on the base of the blade housing.

15. The blade unit of claim 1, wherein there are two pairs of flexible legs, one forward of the plurality of blades and one to a rear of the plurality of blades, a respective plurality of connecting member-engaging protrusions being arranged on the base to engage along lengths of each of the connecting members.

16. The blade unit of claim 12, wherein the blades are in electrical contact with the metal plate via the foot of at least one of the legs, so as to form a galvanic cathodic protection system in which the metal plate functions as a sacrificial anode that corrodes and the plurality of blades function as a cathode that is protected from corrosion.

17. A safety razor comprising the blade unit of claim 1.

* * * * *